US008424620B2

(12) United States Patent
Perry, Jr. et al.

(10) Patent No.: US 8,424,620 B2
(45) Date of Patent: Apr. 23, 2013

(54) APPARATUS AND METHOD FOR LATERAL WELL DRILLING

(76) Inventors: Kenny P. Perry, Jr., Lafayette, LA (US); James M. Savage, Ragley, LA (US)

( * ) Notice: Subject to any disclaimer, the term of this patent is extended or adjusted under 35 U.S.C. 154(b) by 257 days.

(21) Appl. No.: 12/766,844

(22) Filed: Apr. 23, 2010

(65) Prior Publication Data

US 2010/0270080 A1 Oct. 28, 2010

Related U.S. Application Data

(60) Provisional application No. 61/214,393, filed on Apr. 24, 2009.

(51) Int. Cl.
*E21B 7/18* (2006.01)

(52) U.S. Cl.
USPC ..... 175/67; 175/62; 175/77; 175/78

(58) Field of Classification Search ..... 175/62, 175/67, 77, 78, 79
See application file for complete search history.

(56) References Cited

U.S. PATENT DOCUMENTS

| | | | | |
|---|---|---|---|---|
| 3,285,350 | A * | 11/1966 | Henderson | 340/853.5 |
| 6,263,984 | B1 * | 7/2001 | Buckman, Sr. | 175/67 |
| 2001/0045282 | A1 * | 11/2001 | Robinson | 166/298 |
| 2006/0254824 | A1 * | 11/2006 | Horst et al. | 175/61 |

* cited by examiner

*Primary Examiner* — Brad Harcourt

(57) ABSTRACT

An apparatus and method for penetrating earth strata surrounding a wellbore including a nozzle assembly, a flexible tubing connected to the nozzle assembly, and a means to position the nozzle assembly downhole in a substantially horizontal direction into earthen strata, such that the nozzle assembly is connected to one end of the flexible tubing. Embodiments can provide horizontal jetting into the earth's strata from both cased and uncased wells utilizing a rotating, swirling, pulsing or cavitating nozzles which can keep a relatively cuttings free downhole environment.

39 Claims, 10 Drawing Sheets

APPARATUS AND METHOD FOR LATERAL WELL DRILLING

CROSS-REFERENCE TO RELATED APPLICATION

The present application claims priority to U.S. provisional patent application No. 61/214,393 filed on Apr. 24, 2009.

FIELD

The present invention generally relates to a method and apparatus for jet drilling into the earth's strata surrounding a wellbore. More, specifically, the present invention relates to an apparatus and method to provide horizontal jet drilling into the earth's strata from both cased and uncased wells utilizing a rotating, swirling, pulsing or cavitating nozzle head.

BACKGROUND

A large number of wells have been drilled into earth's strata for the extraction of oil, gas, water, and other material there from. In many cases, such wells are found to be initially unproductive, or may decrease in productivity over time. In many of these cases it is believed that the surrounding strata still contains extractable oil, gas, water or other material. Such wells are typically vertically extending holes including a casing used for the transportation of the oil, gas, water or other material upwardly to the earth's surface. In other instances, the wellbore may be uncased at the zone of interest, commonly referred to as an "open hole" completion.

In an attempt to obtain production from unproductive wells and increase production in under producing wells, methods and devices for forming a hole in a well casing, if present, and forming a lateral borehole there from into the surrounding earth strata have been developed and are generally known by those skilled in the art. For example, a hole in cased wells can be produced by punching a hole in casing, abrasively cutting a hole in the casing, or milling out a section of casing. In open hole wells, the steps to form a hole in the casing are not required, but the methods for forming a lateral borehole into the surrounding strata are virtually identical to those used on cased well. Under both the cased and uncased scenarios, a type of whipstock is typically incorporated to direct the nozzle blaster out of the wellbore and into the surrounding formation.

Known methods, however, have generally not been able to provide technically or commercially satisfactory results. For example, when directed at portions of the earth's strata, tests using high pressure fluid exiting a non-rotating fluid nozzle have been incapable of cutting a satisfactory pathway. This shortcoming is due largely to the inability of a stationary type (non-rotating) blaster nozzle to form a passageway into the strata sufficiently large and unobstructed enough to allow for the advancement of the nozzle head. Moreover, the failure of many such systems to adequately address the removal of any formation cuttings that accumulate in the lateral borehole and/or wellbore can impair the efficacy of the jet drilling process. Furthermore, known lateral jetting systems that can effectively cut into formations do not adequately address the centralization of the nozzle head or how to help ensure that it remains on a relatively straight trajectory as it is moved into the earthen strata.

The usage of a rotating nozzle head such as is used in the high-pressure commercial sewer and pipe water cleaning industries, can have applicability to lateral jet drilling, if properly modified. In attempting to directly apply known designs from sewer water blasting to jet drilling, however, one would incur one or more problems. For instance, known rotating nozzle head designs used in commercial sewer and pipe cleaning industries typically employ one or more mechanical bearings and often must incorporate braking or dampening systems to limit their rotational speed. Besides adding undesired complexity, such systems are usually too large (e.g. often 1.25" to 3" in diameter) to be easily transitioned around the tight radius of smaller diameter whipstocks, such as those that are used on casing below about 5.5" in diameter. Besides the difficulty of getting such heads positioned downhole in earthen strata, larger nozzle heads necessitate that more material be removed in order to allow the nozzle to advance. The need to remove more material can dramatically slow down the lateral jetting process, rendering such a method uneconomical on marginal wells. Moreover, the rotating nozzle head on some sewer water blasting or pipe cleaning apparatus extend past the main body, which for purposes of lateral jetting can be highly problematic. For example, the rotating nozzle head can quickly erode if it comes into contact with hard earthen strata; the nozzle head on account of its requisite small size can stop rotating when it comes into contact with the earthen strata because of the minimal torque typically produced by such systems; and, a suitable stand-off distance of the nozzle to the formation is difficult to attain.

The aforementioned issues are further compounded in lateral jet drilling because of the difficulty of precisely controlling the downhole tool string, which is ultimately controlled by an operator who is perhaps many thousands of feet away. For example, a rotating nozzle head as it moves into the earthen strata can stall if unprotected. In addition, the materials released during the lateral jetting process can directly interfere with operation of the nozzle head and/or movement of the flexible hose. Additionally, regardless of whether a rotating, swirling, pulsing or cavitating nozzle is used, such materials can impair the jetting process by filling up the wellbore below the lateral borehole, in turn precluding the removal of cuttings from the lateral borehole.

To control weight on the downhole tools, certain known technologies proscribe utilizing a hose circumscribed with one or more springs. Such a method however is prone to suffer from one or more of the following shortcomings: the springs may provide an opportunity for cuttings or other debris to become trapped therein, bridging off in the lateral borehole, thereby preventing forward movement of the hose; the springs may create turbulent flow patterns allowing for the deposition of cuttings and hence bridging off of the hose; if cuttings become entrapped between one or more coils of the spring, it may cause the nozzle head to change it trajectory or otherwise jam the hose in the lateral borehole; with many formations being naturally fractured, the springs may become stuck in any such cracks or crevices; if the nozzle heads cuts away a softer zone of formation, leaving a ridge or edge, the coils of the spring may become stuck in these; and the coils of the spring may hang-up at the casing due to the occurrence of a incomplete cement-casing bond, potentially causing a catastrophic sticking of the hose in the formation.

Finally, in most known lateral jet drilling methods that can effectively cut earthen formation, the flexible hose used for creating the lateral borehole can become entangled in the tubing sitting atop the whipstock. For purposes of convenience and cost, the production tubing, typically either 2⅜" or 2⅞", is commonly used atop the whipstock. Since the typical hose used for lateral jetting is only semi-rigid and commonly of about ½" to ⅝" in diameter, the wide spacing between the inside diameter of the tubing atop the whipstock and the outside diameter of the flexible hose can allow the hose to buckle when weight is applied and forward travel of the lower portion of the hose is impeded, such as occurs if the jetting nozzle is not cutting a large enough hole or is cutting at a slower rate than the hose is being moved through the whipstock device.

In view of the above, it would be desirable to have a method and apparatus suitable for horizontal well drilling that can produce a lateral borehole of sufficient size and regularity for advancing the downhole tool string into the formation. It would also be desirable to have a method and apparatus suitable for horizontal well drilling that addresses cuttings that accumulate in the lateral borehole and/or wellbore wherein the creation of such cuttings is problematic. In addition, it would be desirable to have a horizontal drilling method and apparatus that has a small rotating nozzle head that can withstand harsh and varied drilling conditions. In addition, it would desirable to have a means to control the motion of the rotating, swirling, pulsing or cavitating nozzle head so as to keep it on a straight trajectory.

SUMMARY

The present invention is directed to methods and apparatus for penetrating into the earthen strata surrounding a wellbore using a nozzle head assembly; it also discloses methods and apparatus for creating a relatively clean wellbore and for containing a hose used in conjunction with nozzle heads that create rotation, pulsation, cavitation or swirling motions in the flow; it is not intended to cover the method or apparatus of non-rotating (stationary) type nozzle blasters that are not designed to rotate, cavitate, pulsate or create swirling motions in the flow.

In an embodiment, the present invention includes an apparatus for cutting horizontally into an earthen formation, including a nozzle assembly having a rotatable nozzle head assembly, a flexible tubing connected to the nozzle assembly, a means to position the nozzle assembly into earthen strata in a substantially horizontal direction, and wherein the nozzle assembly is connected to one end of the flexible tubing and the opposing end of the flexible tubing is coupled to a pumping unit capable of pumping gas, fluid, or a combination thereof through the flexible tubing.

In an embodiment, the apparatus of the present invention for cutting horizontally into an earthen formation includes a hood mechanism to help ensure a suitable stand-off distance between a rotating nozzle head of the rotating nozzle head assembly and the formation, to protect the rotating nozzle head, and to ensure that a minimum diameter hole is cut before the nozzle head is able to advance. In an embodiment, the hood mechanism can include a hood, a cap, or a gauge ring like device located on the forward end of the nozzle assembly.

In an embodiment, the apparatus of the present invention also includes one or more centralizing mechanisms positioned on or near the nozzle assembly. In a further embodiment, the apparatus may include a gauge ring and/or one or more centralizing mechanisms located on the nozzle head and/or flexible hose.

In another embodiment, the apparatus of the present invention includes a means to position the nozzle assembly into earthen strata in a substantially horizontal direction and to optionally circulate gases, fluids or a combination thereof through the positioning means.

In an embodiment, the present invention also relates to an apparatus for ensuring the creation and maintenance of a substantially cuttings-free wellbore below the whipstock. In an embodiment, the apparatus includes a modified whipstock having holes through the bottom of the whipstock and/or externally around the whipstock whereby gases, fluids or a combination thereof may be circulated through the holes initially, periodically or continuously while the rotating, swirling, pulsing or cavitating nozzle head assembly is within the main wellbore or lateral borehole.

In an embodiment, the present invention includes a method for penetrating earth strata surrounding a wellbore including inserting a downhole tool containing a nozzle assembly having a rotatable nozzle head, a flexible tubing connected to the nozzle assembly, a means to position the nozzle assembly into earthen strata in a substantially horizontal direction, and wherein the nozzle assembly is connected to one end of the flexible tubing and the opposing end of the flexible tubing is coupled to a pumping unit capable of pumping gas, fluid, or a combination thereof through the flexible tubing to rotate the nozzle head into a wellbore. The method also includes guiding the downhole tool toward the earthen strata in a substantially horizontal direction so that the nozzle faces at least a portion of earth strata surrounding the wellbore and spraying gas, fluid, or a combination thereof from the rotatable nozzle head into the earth strata and thereby cutting a lateral borehole into the earth strata.

In an embodiment, the present invention includes a method to create a suitable relatively cuttings free environment for the creation of a lateral borehole utilizing either a rotating nozzle head, pulsing nozzle head cavitating nozzle head or one wherein a swirling or pulsing motion like flow pattern is created, or a non-rotating nozzle head wherein the nozzle assembly is rotated. In an embodiment, the method includes removing cuttings by circulating gases, foam, fluids or a combination thereof through, around, and/or above a whipstock while a nozzle head capable of cutting said formation is in the lateral borehole or has been retracted into the whipstock or above the whipstock. In an embodiment, the method includes circulating gases, foam, fluids or combination thereof around through or around a whipstock while a rotating nozzle head is in the lateral borehole or has been retracted into another wellbore.

DETAILED DESCRIPTION

Figure 1:
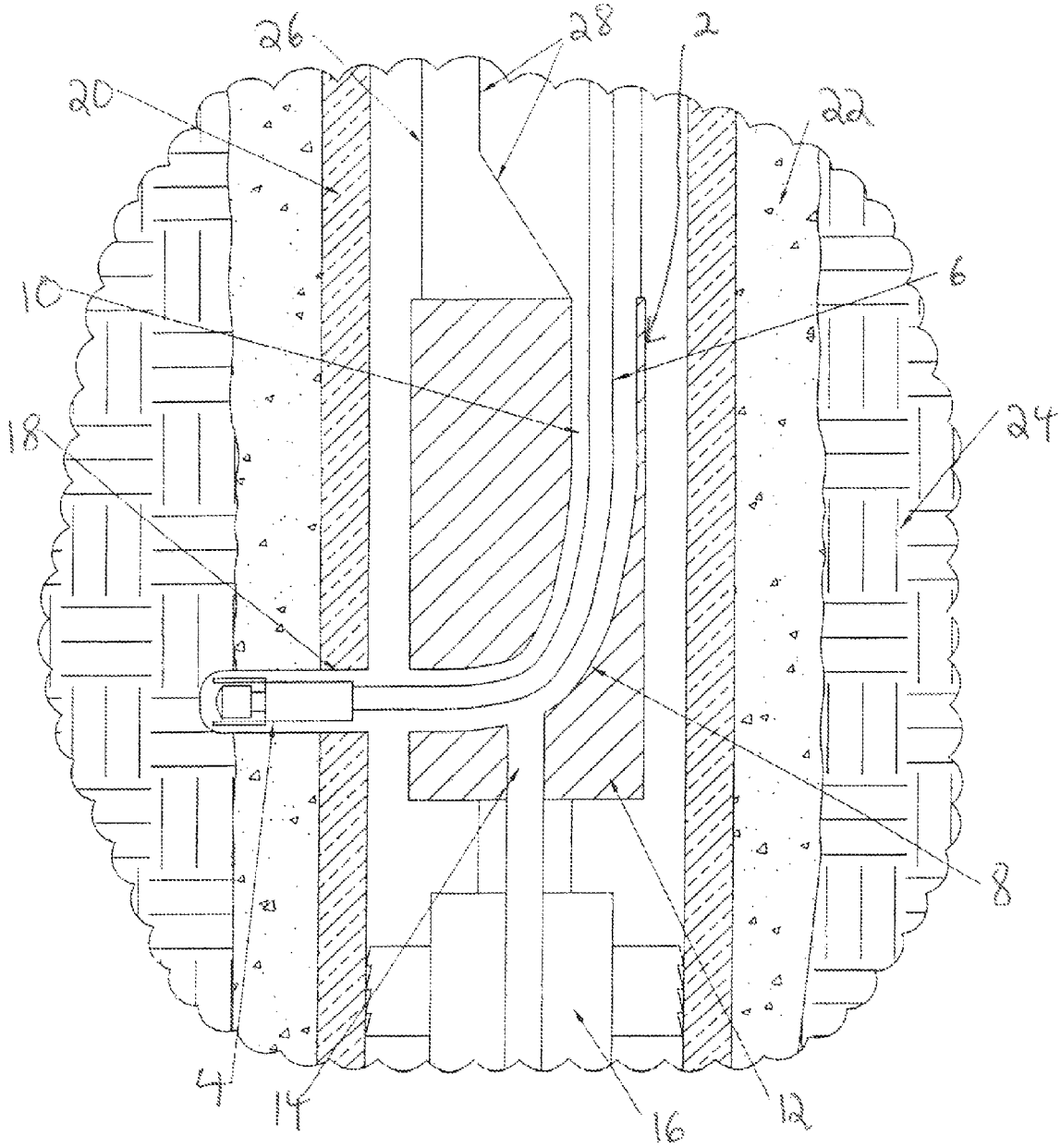
FIG. 1 is a longitudinal cross sectional view of a downhole tool of the present invention having a nozzle head assembly directed into earthen strata through a hole in a milled out section of a casing.

The apparatus of the present invention includes a downhole tool adapted for jet drilling into earthen strata surrounding both cased and uncased wellbores. The downhole tool of the present invention can include flexible tubing, such as a flexible hose or semi-rigid pipe, connected to pumping equipment at one end and connected to a rotatable nozzle head assembly, a pulsing nozzle head assembly, a cavitating nozzle head assembly or one wherein a swirling or pulsing motion like flow pattern is created, or a rotatable nozzle assembly on the other end. The pumping equipment is capable of pumping gas, fluid, or a combination thereof through the flexible tubing and out of the nozzle head assembly.

In an embodiment, a rotatable nozzle head assembly is adapted to create a fluid bearing in the presence of the gases, fluids or combinations thereof flowing from the flexible tube and through the nozzle assembly. In an embodiment, the nozzle head assembly allows for fluid flow out of the frontal space between the rotatable shaft and the main body thereby creating a positive pressure near the nozzle head in order to facilitate debris-free rotation of said nozzle head.

In an embodiment, the fluid, gases or combination thereof leaving the orifices on the nozzle head can generate the rotation of the nozzle head itself. In another embodiment, a shaft connected to the nozzle head is used to generate and transmit torque to the rotatable nozzle head. In yet another embodiment, in the presence of flowing gas, fluid or combination thereof, the interior shape of the main body of the nozzle assembly is used to create a swirling or pulsing pattern in the flow, thereby causing rotation of the rotatable shaft and thus the connected rotatable nozzle head. In an alternative embodiment, the rotatable nozzle head assembly is connected to rotatable flexible tubing. In a further embodiment, a motor is connected to the flexible tubing, wherein the flexible tubing is rotatable. In an embodiment, the motor is driven by the flow of the fluid, gases or combination thereof thereby causing the rotatable flexible tubing to rotate wherein at least a portion of the fluid gases or combination thereof used to drive the motor are transmitted inside the rotatable flexible tubing to the nozzle assembly in order to drive the rotatable nozzle head.

In an embodiment, the nozzle head assembly may contain a rotating nozzle head and a means of securing the rotating nozzle head assembly to flexible tubing. In an embodiment, the combination of the nozzle head assembly with the flexible tubing allows for a fluid bearing to be created upon the pumping of a fluid, gas or combination thereof into the flexible tubing and subsequent nozzle head assembly. The nozzle head assembly may also allow fluid, gases or some combination thereof to flow through an interior passageway(s) into a space or chamber located inside the nozzle head. In an embodiment, the nozzle head has at least one orifice wherein the fluid, gases or combinations thereof exit the nozzle head assembly. In an aspect, the nozzle head assembly includes a nozzle body and a rotatable barrel body.

In an alternative aspect, the nozzle body includes a rotatable barrel body and the rotatable barrel body includes the rotatable shaft such that the rotatable shaft is located inside the rotatable barrel body, wherein the rotatable barrel body contains at least one orifice at the rear of the barrel body and at least one orifice closer to the front of the barrel body such that a portion of the fluids, gases, or combinations thereof from the flexible tubing traverse an interior space of the barrel body creating a fluid bearing between the rotatable shaft and the barrel body and are delivered to the nozzle head. In another embodiment, the at least one orifice has a centerline that is pitched at an angle different than the angle of the axis of rotation of the nozzle head. In a further embodiment, the nozzle head has at least two orifices wherein at least one orifice is asymmetrically oriented. In an aspect, the nozzle head has at least one orifice skewed with respect to the axis of rotation of the nozzle head so as to provide a rotational impetus to the nozzle head.

In an embodiment, rotation of the nozzle head can be imparted from differential thrust created by the exiting gas or fluid acting on the nozzle head itself or on an attached rotatable shaft. In an embodiment, the nozzle head can include exit ports located on the front or back of the nozzle head itself, which upon flow of fluid, gas or combinations thereof, cause an imbalanced net thrust and hence impart rotation. In another embodiment, the thrust can be created by one or more ports on an attached shaft apparatus, wherein the one or more ports are sized, angled or located so as to cause an imbalanced net thrust, upon flow of fluid, gas or combinations thereof, on the rotatable shaft and attached nozzle head. In a further embodiment, thrust can be created by one or more exit orifice(s) located on the main body of the nozzle assembly, such that any gases or fluids exiting said orifice(s) cause an opposite rotational thrust on the shaft and attached nozzle head.

In an embodiment, the rotatable shaft of the nozzle head assembly contains one or more spirally-oriented internal or external fins, flutes, grooves or rifling, causing the shaft to act as if an impeller when subjected to flow of fluids, gases or combinations thereof. The flutes, grooves or rifling can be either on the inside or the outside of the rotatable shaft, or both. Furthermore, spirally-oriented flutes, grooves or rifling may also be situated about the inside of the main nozzle body in which all or part of a shaft can turn, in this case the flutes, grooves or rifling may impart a spiral flow pattern in the flowing gas, fluid or mixed combination, which can, in turn, transmit the impetus for rotation to the rotatable shaft and attached nozzle head.

In an embodiment, the nozzle assembly itself is rotatable. Rotation of the nozzle assembly can be advantageous in order to more readily allow it to transition through the radius of the whipstock and to move into to and out of the earthen formation. A further advantage to a having a rotated nozzle assembly, regardless of its internal operation, is that if there is a failure on the part of an internal mechanism to create the otherwise desired rotation, pulsing or swirling, the rotated nozzle assembly may yet be capable of cutting the formation. That is, there is a redundant mechanism by which the formation can be cut. Rotation of the nozzle assembly may be accomplished by rotating a portion or all of the attached flexible tubing such as by a motor or by other means familiar to those in the art.

In an embodiment, the nozzle head assembly contains a hood mechanism. In an embodiment, the hood mechanism is attached to and/or integrated with the nozzle assembly in a manner such that the hood mechanism is positioned over and/or around a nozzle head. In another embodiment, the hood mechanism substantially surrounds the nozzle head. In a further embodiment, the hood mechanism covers at least a portion of the circumference of the nozzle head. The hood mechanism may be designed to create a specific stand-off distance(s) between the earthen formation being jetted and the exit orifice(s) of the nozzle head thereby allowing for suitable jet drilling of the formation. The hood may also prevent a rotating nozzle from coming into contact with the earthen formation, which could wear down the nozzle head and/or cause the nozzle head to stop rotating. In another embodiment, the nozzle hood can be installed as a cap around the nozzle head, such that the hood surrounds a frontal circumference of the rotating nozzle. In a further embodiment, the nozzle hood is integrated with or attached to the nozzle assembly whereby the hood surrounds a circumference of a rotatable nozzle head and extends past or nearly past the front of the rotatable nozzle head such that a portion of the rotatable nozzle head is recessed into the hood mechanism. In an even further embodiment, the nozzle hood is integrated with or attached to the nozzle assembly whereby the hood surrounds all of a rotatable nozzle head and extends past the front of the rotatable nozzle head such that the rotatable nozzle head is completely recessed into the hood mechanism.

In an embodiment, the hood mechanism is designed so as to closely fit the nozzle head thereby acting as a choke point that minimizes the ability of cuttings or other debris from partially or totally filling any space between the hood and the rotating nozzle head, which could slow or stop rotation of the nozzle head. In an embodiment, the hood mechanism has perforations, grooves, and/or slots thereby allowing any cutting that may accumulate between the hood and the nozzle head to freely exit. In an embodiment, the hood has slots, grooves or holes that traverse the hood's forward and interior side towards its generally exterior and rear side. In an aspect, the nozzle head and the perforated hood could allow for the orifices on the nozzle head to cut the formation through slots in the perforated nozzle hood.

In an embodiment, the gap between the nozzle head and the hood mechanism is small so as to minimize the possibility of debris become lodged therein. In an embodiment, the rear of the nozzle head may be tapered to a smaller outer diameter than the forward edge of the nozzle head. Having a tight fitting forward gap between the side of the nozzle head and hood may help prevent debris from lodging in this gap, possibly stalling rotation. Furthermore, having a tapered nozzle head, with larger forward diameter, may allow any material that does get between the nozzle head and hood to move to an area of relatively larger space, thereby limiting the chances of stalling the rotating nozzle head. In addition, leakage of fluid flow from between the rotatable shaft and the main body into the area of the nozzle head may cause a higher pressure in the hood area, which may help prevent debris buildup around the rotating nozzle head and/or frontal portion of the rotatable shaft.

In an embodiment, the downhole tool of the present invention is connected to an assembly that can be used to lower the downhole tool inside a wellbore. In an embodiment the downhole tool is connected to a wireline assembly for placement and retrieval. In another embodiment, the downhole tool is connected to a section of tubing. In an aspect the tubing can include upset tubing or other non-upset tubing. In a further embodiment, the downhole tool is connected to a spool of tubing that can be lowered down a wellbore.

In an embodiment, the downhole tool of the present invention is contained in a tubing containment system prior to lowering of the downhole tool inside of a wellbore. In an embodiment, the tubing containment system includes one or more collapsible sleeves. In this embodiment, the collapsible sleeves are in an extended position and positioned atop a whipstock. Force is then applied to the sleeves causing them to collapse. When the collapsible sleeves collapse, the flexible tubing within the collapsible sleeves is lowered into a guide channel in the whipstock.

In an embodiment, the tubing containment system includes one or more collapsible centralizers. In an embodiment, the one or more collapsible centralizers can be affixed to a given position on the flexible tubing and oriented radially around the flexible tubing. In an embodiment, this tubing containment system is capable of transitioning through the whipstock. This tubing containment system can keep the flexible tubing from collapsing over itself in the tubing located above the whipstock and can keep the flexible tubing and nozzle head assembly centralized in the lateral borehole. In an aspect, the one or more collapsible centralizers include bow-spring centralizers and/or pin centralizers. The bow-spring centralizers can be oriented lengthwise on the flexible tubing and the pin centralizers may extend radially from the flexible tubing.

In an embodiment, the tubing containment system includes a series of stackable sleeves containing the flexible tubing. In this embodiment, the stackable sleeves are in a stacked position and positioned atop a whipstock. Force is then applied to the sleeves causing them to "stack-out" above one another atop the whipstock. When the stackable sleeves stack-out above one another, the flexible tubing within the stackable sleeves is lowered into a guide channel in the whipstock. In a particular example, a 1-inch long sleeve is placed every foot along a 30 foot flexible tubing and when force is applied, the stackable sleeves would form a stack of stackable sleeves that is 30 inches long, resulting in the end of the flexible tubing containing the nozzle assembly being 27.5 feet beyond the top of the whipstock.

In another embodiment, the flexible tubing containment system includes a lower section that is adaptable to the whipstock in order to form a seal with the whipstock. This seal may restrict the backflow of fluid and materials up the whipstock so as to seal out any cuttings washing back from the lateral borehole. This is desirable in order to keep cuttings from clogging the guide path, or channel, of the whipstock, which could inhibit the free travel of the flexible tubing.

In an embodiment, the downhole tool of the present invention includes a section of tubing situated on top of a whipstock. In order to prevent buckling of the flexible tubing that is connected to the nozzle head and is transitioned through the whipstock when weight is applied, the piece of tubing sitting atop the whipstock can be modified so as to have a smaller diameter than the standard 2⅜" production tubing, typically used in the art. In an aspect, the inside diameter of this modified tubing is at least 1.1 times the outside diameter of the flexible tubing attached to the nozzle head assembly. In another aspect, the inside diameter of the modified tubing is from 1.25 to 2 times the outside diameter of the flexible tubing. In another aspect, the inside diameter of the modified tubing is from 2 to 3.5 times the outside diameter of the flexible tubing. In an alternative embodiment, a rigid pipe style containment system through which the flexible tubing can pass is positioned inside of the production tubing (or similar tubing) sitting atop the whipstock. This rigid pipe containment system can be used to prevent the flexible tubing that is transitioned through the whipstock from buckling in larger diameter tubing located above the whipstock when weight is applied. In an embodiment in which a containing pipe is used, the containment pipe can be held in place above the nozzle head assembly by a slip-type connection having a smaller inside diameter than at least one outside diameter of the nozzle head assembly, through which the flexible tubing is able to advance. Other suitable containment methods can also be utilized.

In an embodiment, the flexible tubing, hose or semi-rigid pipe connected to the rotating nozzle head assembly can be fed, or transitioned, through a whipstock and into the earthen formation for the jet drilling of a lateral borehole at high pressures. In an embodiment, these pressures are greater than 2,000 psi. In another embodiment, these pressures are from 3,000 to 20,000 psi. In an alternative embodiment, these pressures are from 5,000 to 15,000 psi. In a further embodiment, the jet drilling is performed under pressures of from 7,000 psi to 10,000 psi. In an embodiment, the operating flow of the gas, fluid or combinations thereof ranges from 6 to 12 gallons per minute (gpm). In another embodiment, the operating flow ranges from 10 to 20 gpm. In a further embodiment, the operating flow ranges from 15 to 35 gpm. In an embodiment, the whipstock includes one or more passageways that allow cuttings, sand, paraffins, scale and/or materials to fall below the whipstock and to be circulated out by the flow of fluids, gas or a combination thereof.

In an embodiment, the flexible tubing is selected from the group of a multi-braid hose, a single braid hose, a fabric-circumscribed hose (e.g. Kevlar®), and semi-rigid tubing. In another embodiment, the flexible tubing includes a multi-braid hose. In a further embodiment, the flexible tubing does not contain a spring or any other stiffening mechanism permanently attached to and on the outside of the flexible tubing. In an alternative embodiment, the flexible tubing does not contain a spring or any other stiffening mechanism on its outer surface when the nozzle assembly is deployed in a cutting position, such as after the nozzle assembly has transitioned through the whipstock.

In an embodiment, the whipstock of the downhole tool of the present invention may be designed to allow the cuttings that are created by the lateral jetting processes to be circulated out of the wellbore or circulated out of the whipstock toward the wellbore below the whipstock. In an embodiment, the whipstock contains one or more internal flow passageways. In an embodiment, the whipstock contains one or more external bypass lines that can allow flow to traverse around the whipstock. In a further embodiment, the whipstock contains both internal and external passageways. In an embodiment, material created from a jetting process exits the downhole tool falling below the whipstock through the internal flow passageway. In an embodiment, gases, fluids or a combination thereof are circulated through the internal and/or external bypass line in order to clean out the cuttings from the whipstock and the wellbore below the whipstock. In an aspect, a second tubing string may be incorporated into the downhole tool apparatus of the present invention in order to provide for a smaller cross-section area through which to circulate. In an embodiment, the second tubing string is positioned inside the tubing sitting atop the whipstock. In another embodiment, the second tubing string is attached to the outside of the tubing sitting atop the whipstock.

The present invention is also directed to a method of jetting earthen strata surrounding both cased and uncased wells. In an embodiment, the method can include inserting a flexible tubing having at one end a nozzle assembly having a rotatable nozzle head with at least one orifice on one end of the rotatable nozzle head into tubing in a wellbore. In an embodiment, the tubing is positioned on top of a whipstock having a guide path. In an embodiment the method includes: inserting the flexible tubing along the guide path of the whipstock until the rotatable nozzle head protrudes from the whipstock; injecting a gas and/or fluid at high pressure, such as between 4,000 and 20,000 psi into the flexible tubing, wherein the gas and/or liquid exits the at least one orifice in the rotatable nozzle head and creates a fluid bearing between the rotatable nozzle head and the nozzle assembly; jetting a lateral borehole in the earth's strata with the gas and/or fluid exiting the rotatable nozzle head.

The jetting process of the present invention can be used in conjunction with the removal of cuttings from the wellbore and/or lateral borehole. In embodiments, the method includes removing cuttings from a wellbore in which efficacious lateral jetting (i.e. one producing problematic cuttings) is being conducted. In an embodiment, the method can include circulating gases, fluid or a combination thereof down the tubing and up an annulus area of the wellbore. In another embodiment, the method can include circulating gases, fluid or a combination thereof down the annulus and up the tubing. In an embodiment, the exit/entry point of the circulating gases/fluids into the tubing string can be located near or below the lowest part of the downhole tool. In another embodiment, the exit/entry point of the circulating gases/fluids into the tubing string can be located near or below the whipstock and optional packer. The step of circulating to clean out cutting and materials in the wellbore can be done prior to the cutting the lateral borehole, periodically as needed during the process, or continuously. In an aspect, a second tubing string can be utilized in the step of removing cuttings from the wellbore and/or lateral borehole. In an aspect, the second tubing string can be used to circulate gases, fluid or a combination thereof down the second tubing string and up an annulus area of the wellbore. In another aspect, the second tubing string can be used to circulate gases, fluid or a combination thereof down the annulus and up the second tubing string.

In an embodiment, the downhole hose containment apparatus and methods for cleaning a wellbore disclosed herein may be used in conjunction with nozzle assemblies that rotate, pulse, create cavitation or create a swirling motion in the fluid or gas spray pattern. Pulsing nozzle head assemblies typically work by mechanical flow-blocking or mechanical flow-adjustments or produce pulsation by self-excitation of the jet flow. For example, the pulsing motion may be accomplished by having one or more orifices that are cyclically opened and closed or it may be created by one or more fast-acting valves or by a swirling disk that alternately opens and closes flow to an orifice. Cavitating nozzles typically have a series of specially designed chambers that facilitate the creation of cavitation bubbles. Nozzles that create swirling motions in the spray pattern typically do so by one or more fins, grooves, slots, perforated disks or orifices asymmetrically aligned to the longitudinal axis of the nozzle head assembly and are known by those familiar in the art.

FIG. 1 is a view of a downhole tool 2 of the present invention having a nozzle head assembly 4 with a fluid bearing (not shown) connected to a flexible tubing 6 as it transitions through the radius 8 of the guide channel 10 of a whipstock 12. The guide channel may be used for directing the nozzle head assembly from the whipstock to the adjacent earthen formation 24. Through the bottom of the whipstock is an optional flow channel 14 that allows cuttings and circulating gases, fluids, or combinations thereof to flow below the whipstock through an optional packer/anchor 16 used for centralization/stabilization. In this embodiment, the nozzle head assembly 4 is directed through a milled section of casing 18 in the adjacent wellbore casing 20 and cement 22, if present, and into earthen formation 24. Optionally, to facilitate the guidance of the nozzle head assembly 4 thru the whipstock 12 and to help guide the travel of the flexible tubing 6, the tubing 26 interior, or upper portion of the whipstock, may be of a relatively smaller diameter than standard and/or may have a tapered surface 28.

Figure 2:
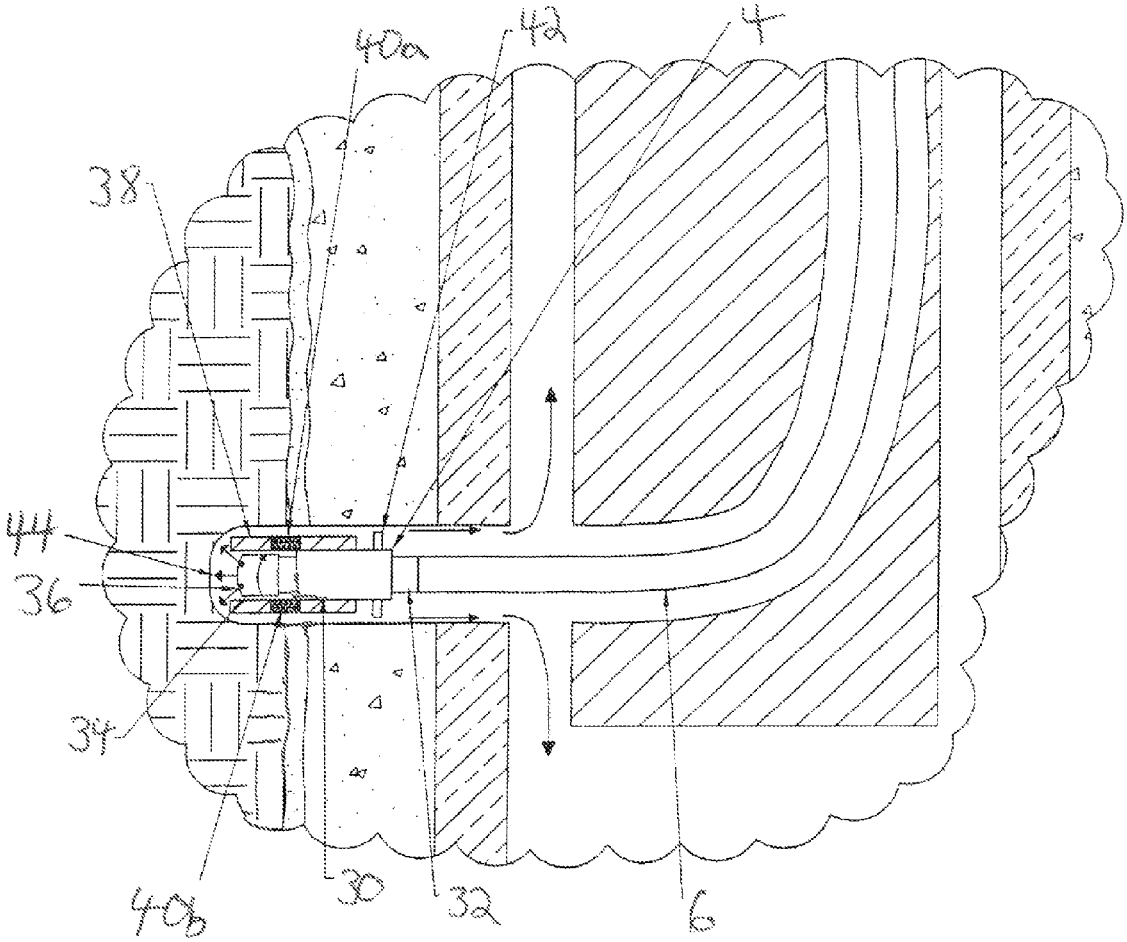
FIG. 2 depicts a more detailed view of the nozzle head assembly of FIG. 1 and includes an optional centralizing mechanism.

FIG. 2 is a more detailed view of the nozzle head assembly of FIG. 1. The main nozzle body 30 can be seen with an anterior section or attachment means 32 allowing it to be secured to a flexible tubing 6 and a forward-located rotating nozzle head 34 with one or more exit orifices 36 each of which is connected to an interior passageway (not shown) through the tool to the flexible tubing 6 allowing the flow of gases, fluids or a combination thereof. The nozzle head assembly 4 has a forward located hood or shield 38 that serves to protect the rotating nozzle head 34. The hood 38 may have one or more, cuts, groves, or holes (40*a,b*) which allow for fluid, gases or cuttings to pass around or through the hood 38 and out of the lateral borehole and towards the wellbore (as shown by arrows). An optional centralizing mechanism(s) 42, shown here as flexible pins, can be placed toward the middle or anterior of the nozzle body 30 or can be positioned on the tubing 6, in order to help ensure that the nozzle head assembly 4 remains substantially aligned along the same axis of travel as the lateral borehole 44.

Figure 3A:
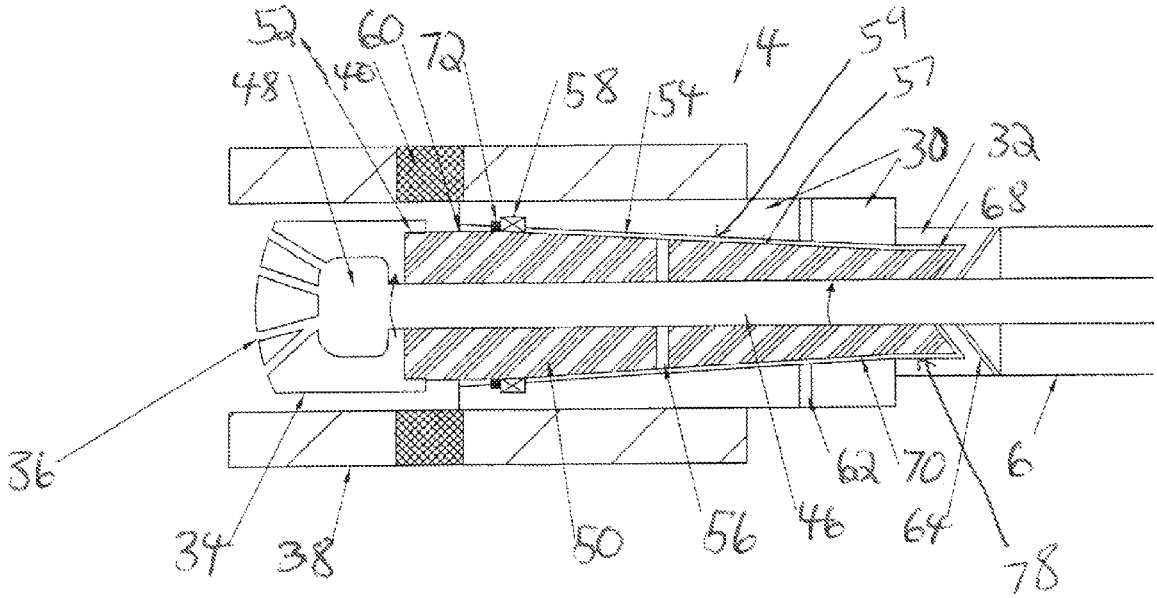
FIG. 3A is a longitudinal cross sectional view of an embodiment of a nozzle head assembly designed to create a fluid bearing in the presence of flow and wherein the primary flow path is through the center of the shaft.

FIG. 3A is a closer view of an embodiment of a nozzle head assembly 4 showing an interior passageway 46 for the transport of gases, fluids or combination thereof to a chamber 48 located in the rotating nozzle head 34 having one or more exit orifice(s) 36. At the front of the main body 30 is hood 38, which may be a separate apparatus from or made as one piece with the main body 30. The hood 38 may have one or more openings, such as cuts, grooves, holes, or perforations 40 through which gases, fluids or solids can pass, such as jetting fluids with formation cuttings. In the interior section of the main body 30 is a rotatable shaft apparatus 50 to which the nozzle head 34 (note arrows depicting rotation) is attached at connection 52. The nozzle head 34 and rotatable shaft 50 may be separate but connectable apparatus or made as a single unit. A fluid or gas bearing 54 occupying the space between the exterior surface 57 of the rotatable shaft 50 and the interior surface 59 of the main nozzle body 30 is created in the presence of flow of gases, fluids, and combinations thereof and allows for the rotation of shaft 50. If flow is desired, such as for the purpose of creating a fluid bearing 54, then the flow can be created by a combination of two or more orifices 56 situated so as to traverse from the interior to the exterior of the shaft 50, so as to circumscribe the back of the shaft 78, so as to exit the main body 30 through orifice 62, and/or so as to exit near the front of the shaft 60. For further stabilization of the rotatable shaft 50 may be accomplished by one or more thrust or radial bearings 58 near situated about the shaft 50.

The main nozzle body 30 may allow for the expulsion of gases or fluids or a combination thereof toward the front of the main nozzle head body 60 and/or via side exhaust port(s) 62 that span between the interior and exterior of the main nozzle body 30. Thrust to propel the nozzle assembly 4 forward can be created by one or more rear-facing exit ports 64 on the attachment 32 or main nozzle body 30 (shown here on attachment 32, only). The rotation of the nozzle head 34 and attached barrel/shaft 50 can be achieved by asymmetrically oriented orifice(s) 36 on the nozzle head itself 34 whereby the exiting fluid and/or gas causes the rotation of the nozzle head 34 and attached barrel/shaft 50 along the longitudinal axis of the nozzle head assembly 4, or by adjusting the size/angles of the orifice port(s) 56 traversing through the barrel/shaft 50 or orifice(s) 56 traversing through the main nozzle body 30. The rotatable barrel/shaft mechanism 50 may have an extended inlet stub 68 that helps ensure the centralization and smooth rotation of the rear portion of 70 of the shaft/barrel 50. A seal mechanism 72 and/or tight machining tolerances (not shown), may be used at the forward end of the main body 30 to keep excessive fluid, gases or combination thereof under high pressure from escaping at the gap between the rotatable barrel/shaft 50 and non-rotating main body 30.

Figure 3B:
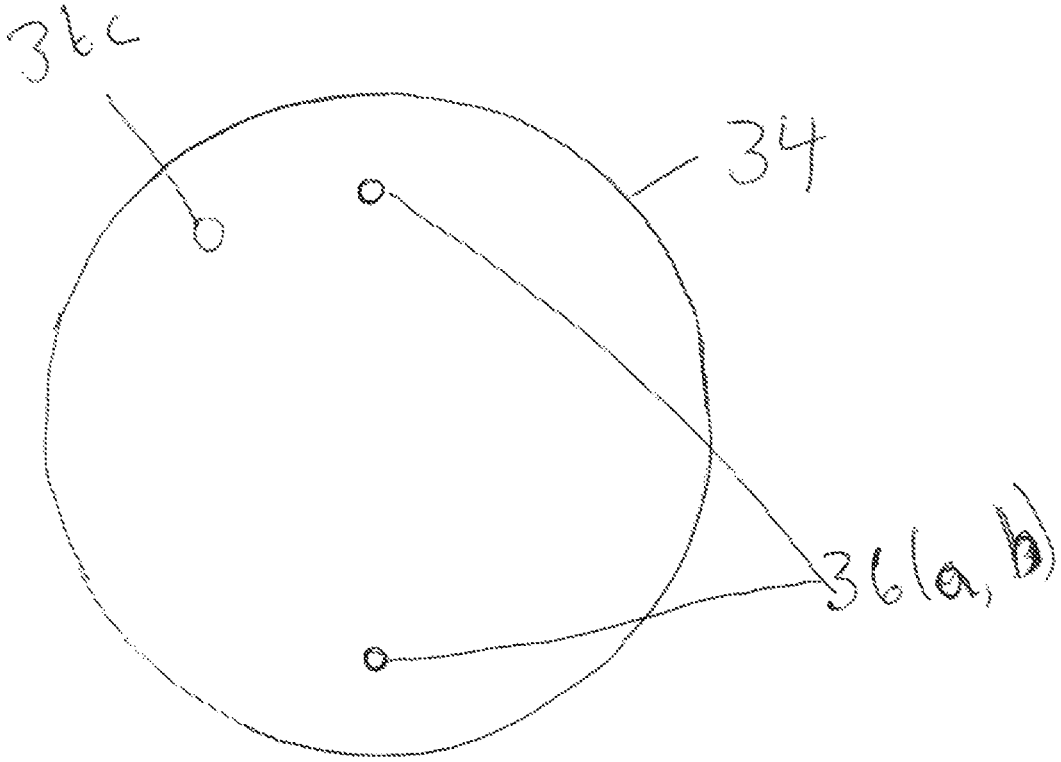
FIG. 3B depicts a frontal view of a nozzle head with exit orifices, showing 2 exit orifices oriented symmetrically about the nozzle head and one asymmetrically.

FIG. 3B depicts a frontal view of a nozzle head 34 wherein two orifices (36*a,b*) are positioned normal to the nozzle head's axis of rotation and one orifice (36*c*) is asymmetrically oriented so as to impart rotation of said nozzle head 34 (see arrow).

Figure 4A:
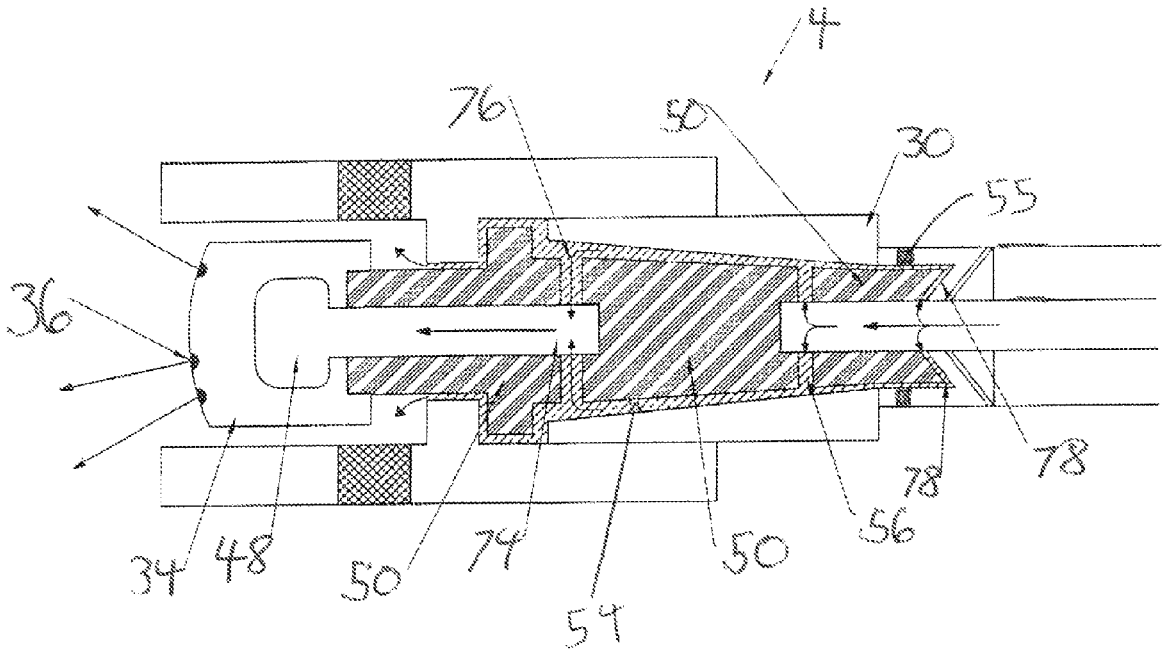
FIG. 4A is a longitudinal cross sectional view of an alternative embodiment of a nozzle head assembly wherein the primary fluid flow path traverses at least a portion of the exterior of a rotatable shaft.

FIG. 4A is a view of an alternate embodiment of a rotating nozzle head assembly 4, having a function and operation that is generally similar to that described above in FIG. 3A. In this embodiment, instead of the flow path used to create the fluid bearing 54 being through the center of the entire shaft 50, as in FIG. 3A, flow comes through optional orifices 56 traversing the interior to the exterior of the rearward part of the barrel 50 (as depicted by the arrows in FIG. 4A). The gas, fluid or combination thereof re-enters the interior passageway 74 of the shaft 50 through one or more ports 76 and then flow to the interior space 48 and out one or more orifices 36 on the nozzle head 34. In an embodiment, flow (shown by arrows) around or near the front of the shaft 50 may be allowed to facilitate the creation of a fluid bearing 54 and/or provide a positive flow around nozzle head 36 for debris free rotation. In an embodiment, at the rear of the shaft 50 gas and/or fluid flow is directed around the shaft as shown by arrows 78, re-entering the shaft 50 at port(s) 76.

Furthermore in FIG. 4A, forward thrust acting on the nozzle assembly 4 can be imparted in the presence of flow by one or more rear-facing exit ports 64 located on the attachment 32 or main nozzle body 30. The rotatable shaft mechanism 50 may have an extended inlet stub 68 and optional rear located bearing 55 that helps ensure the centralization and smooth rotation of the rear portion of 70 of the rotatable barrel 50. An optional seal mechanism (not shown) and/or tight machining tolerances (not shown), may be used at the forward end of the main body 30 to stop or limit the flow of fluid, gases or combination thereof under high pressure from escaping at the gap between the rotatable shaft 50 and main body 30. The rotation of the nozzle head 34 may also be imparted thru the rotatable shaft 50 or by optional orifice(s) (not shown) traversing through the main nozzle body 30 as illustrated in FIGS. 4B and 4C, below.

Figure 4B:
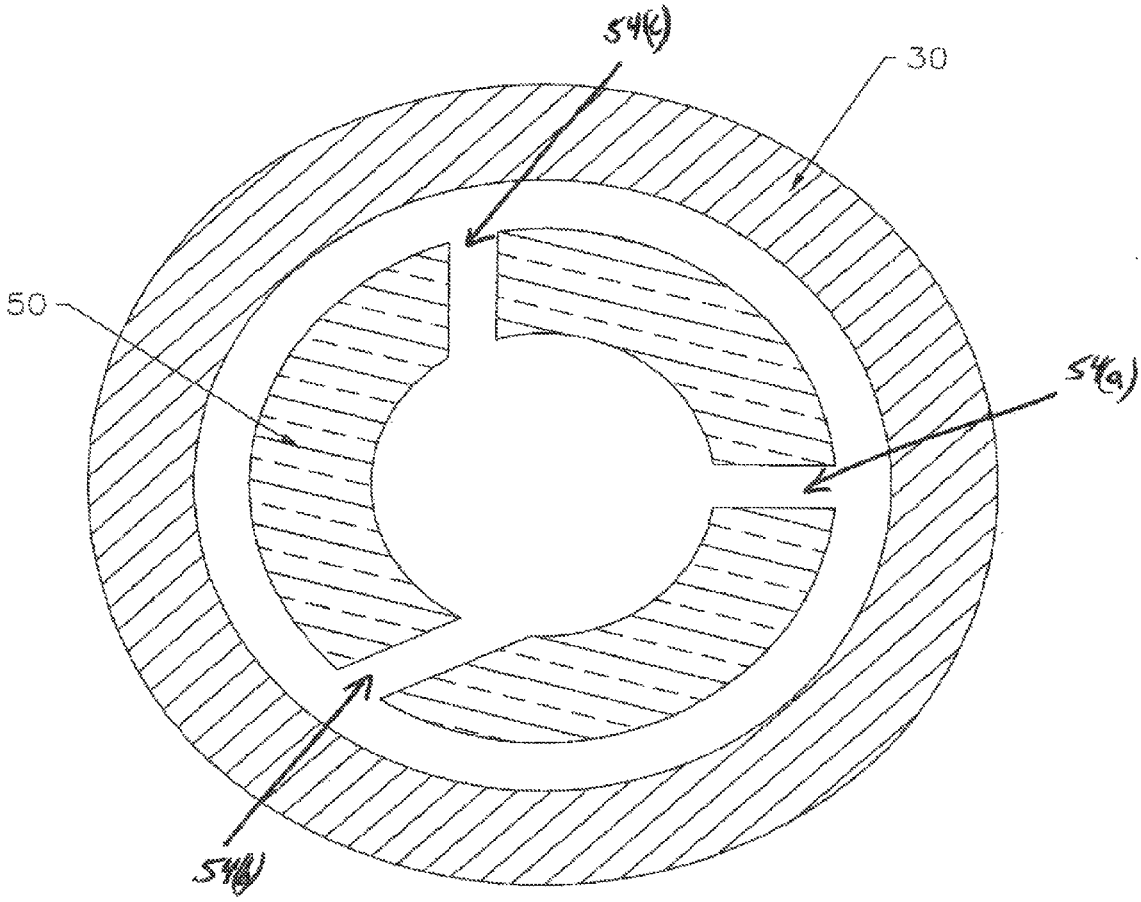
FIG. 4B depicts a radial cross-sectional view of an alternative embodiment of a fluid bearing nozzle head assembly having a rotatable shaft imparting rotation.

FIG. 4B shows a radial cross section of the rotatable shaft 50 located in the main body 30 wherein one orifice (54*a*) is positioned normal with respect to the axis of rotation, and wherein rotation (see arrow) of the shaft 50 is imparted by one or more orifices (54*b,c*) positioned asymmetrically with respect to the axis of rotation of the shaft 50.

Figure 5:
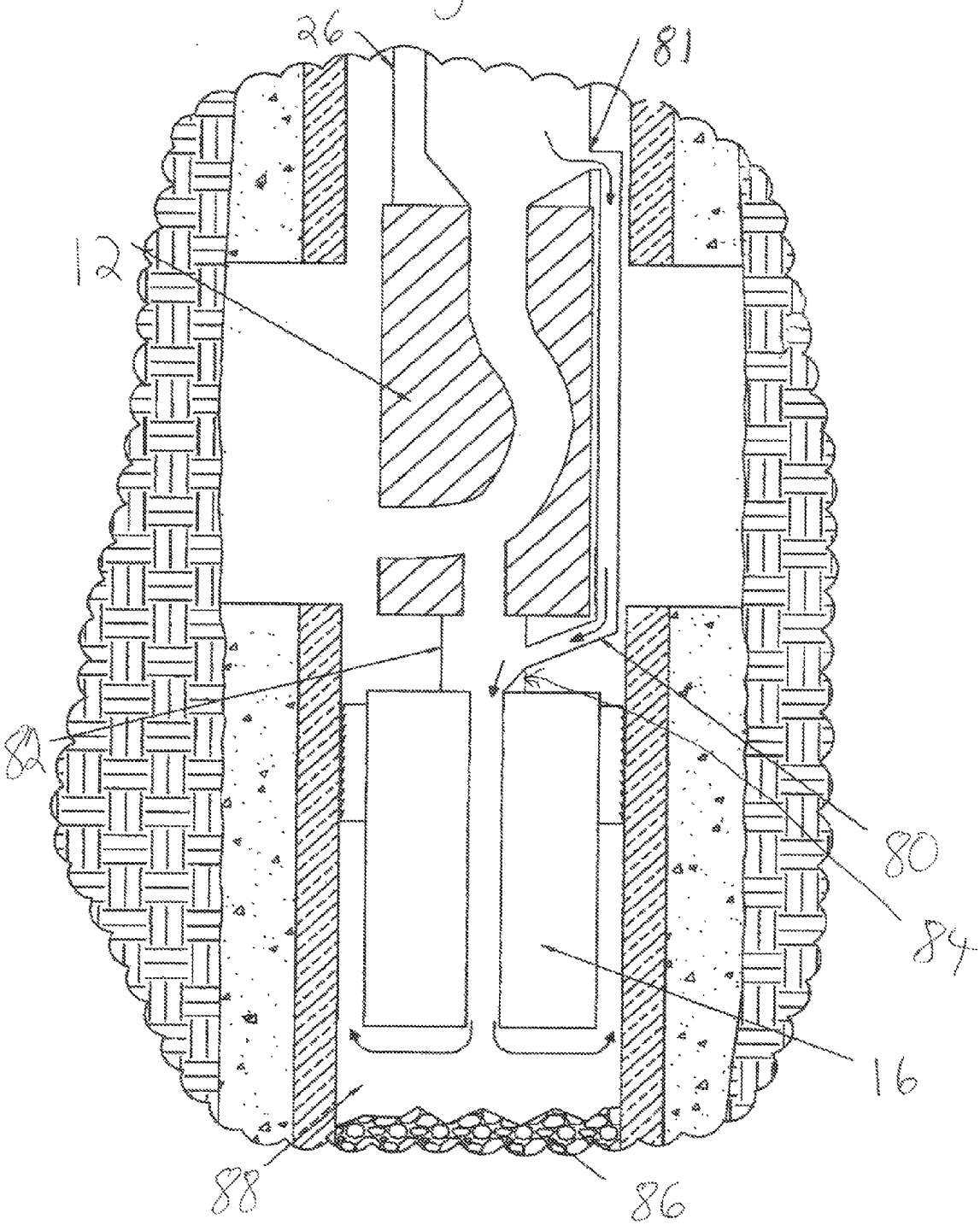
FIG. 5 is a longitudinal cross sectional view of a downhole tool having an external bypass to a whipstock.

FIG. 5 shows an open-hole well wherein an optional external bypass 80 to the whipstock 12 is used to allow for higher volumes of flow, the direction of which is depicted by the arrows, for the circulation of fluid, foam, gases or some combination thereof to below the whipstock 12. In this embodiment, the circulating fluid, gas or combination thereof moves from the tubing 26 above the whipstock 12 through a connection point 81 through the external bypass 80 and re-enters tubing 82 below the whipstock 12 through connection point 84. The flow (with the arrows denoting flow direction) can then travel below the optional packer 16 to wash down any cuttings 86 from the wellbore 88.

Figure 6A:
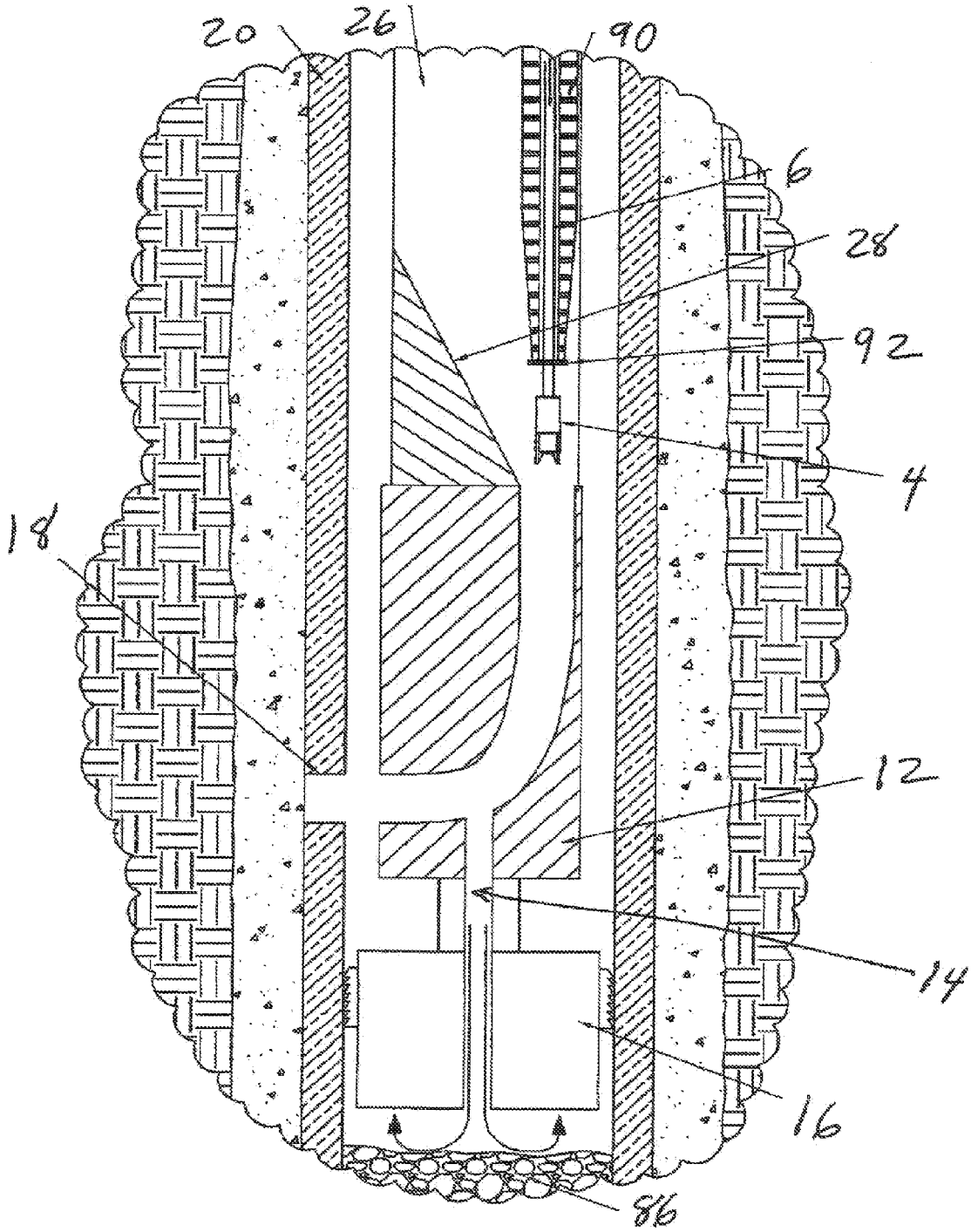
FIG. 6A is a longitudinal cross sectional view of a nozzle head assembly connected to a hose located inside a hose containment apparatus of a downhole tool.

FIG. 6A depicts an embodiment of a rotation, swirl, cavitation or pulse producing nozzle head assembly 4 positioned in a wellbore 88 wherein a hole 18 has been made through the casing wall 20. In this case, the nozzle head assembly 4 is connected to a flexible tubing 6, located inside a flexible tubing containment apparatus 90 positioned in tubing 26 sitting atop a whipstock 12. In this embodiment, the nozzle head assembly 4 is secured to the flexible tubing 6 via a slip-type connect 92, which allows the flexible tubing 6 to pass through the connection 92. The jet hose containment apparatus 90 prevents the flexible tubing 6 from buckling in the much larger diameter tubing 26 if weight is applied during the lateral jet drilling process. Optionally, to facilitate the guidance of the nozzle head assembly 4 thru the whipstock 12 and to help guide the travel of the flexible tubing 6, the tubing 26 interior, or upper portion of the whipstock 12, may have a tapered surface 28. An optional passageway 14 is shown below the whipstock 12 with flow (with arrows denoting flow direction) pumped down the tubing 26 to circulate out cuttings 86 beneath an optional packer 16.

Figure 6B:
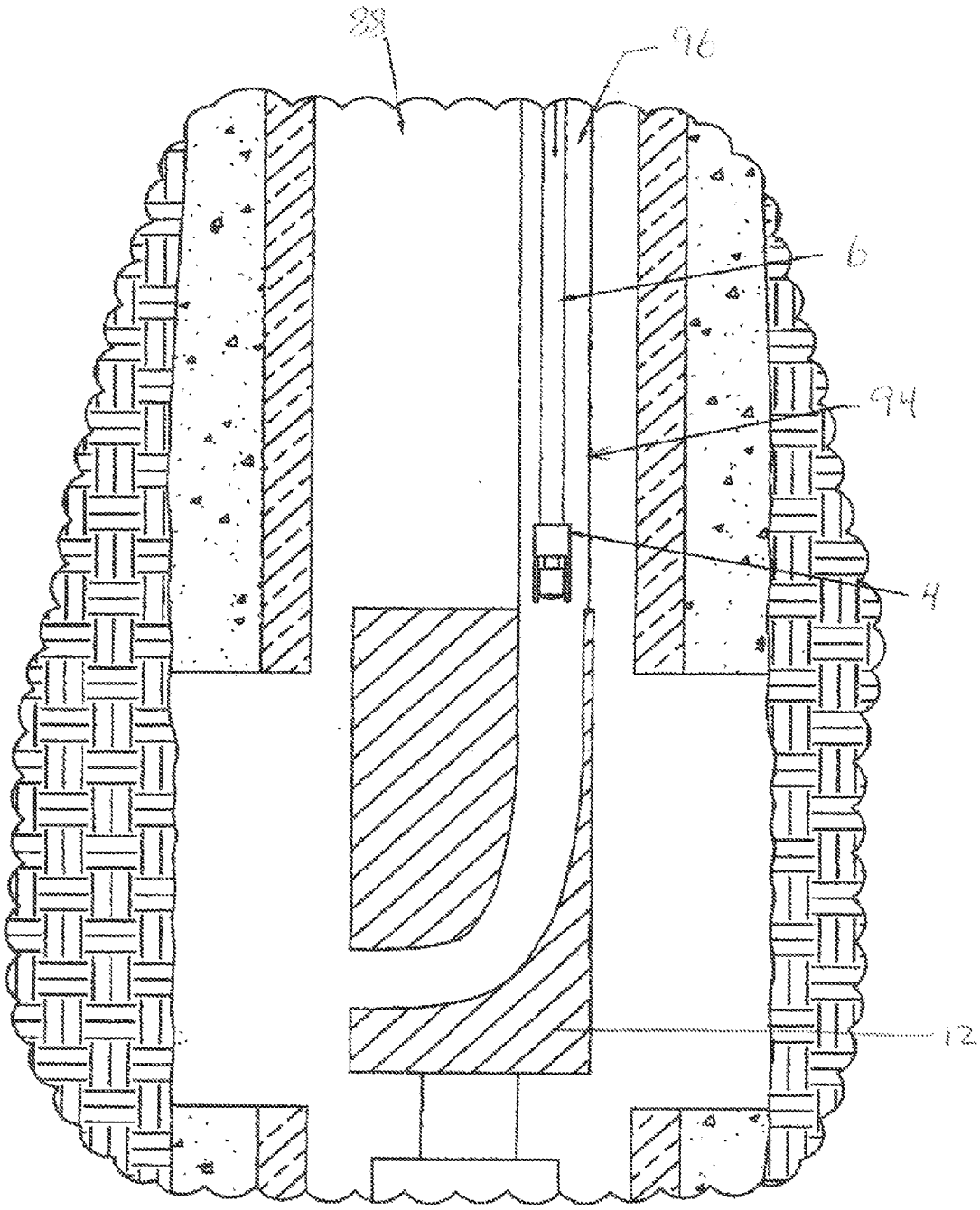
FIG. 6B is a longitudinal cross sectional view of a modified embodiment wherein control of the nozzle head assembly and flexible tubing is maintained by connecting a tight fitting piece.

FIG. 6B depicts an embodiment wherein control of the nozzle head assembly 4 and flexible tubing 6 is maintained by connecting tubing (94) having a diameter 96 (e.g. approximately 1-2.5 times the outside diameter of the flexible hose) immediately above the whipstock 12, thereby helping prevent the flexible tubing 6 from bucking, when weight is applied.

Figure 7A:
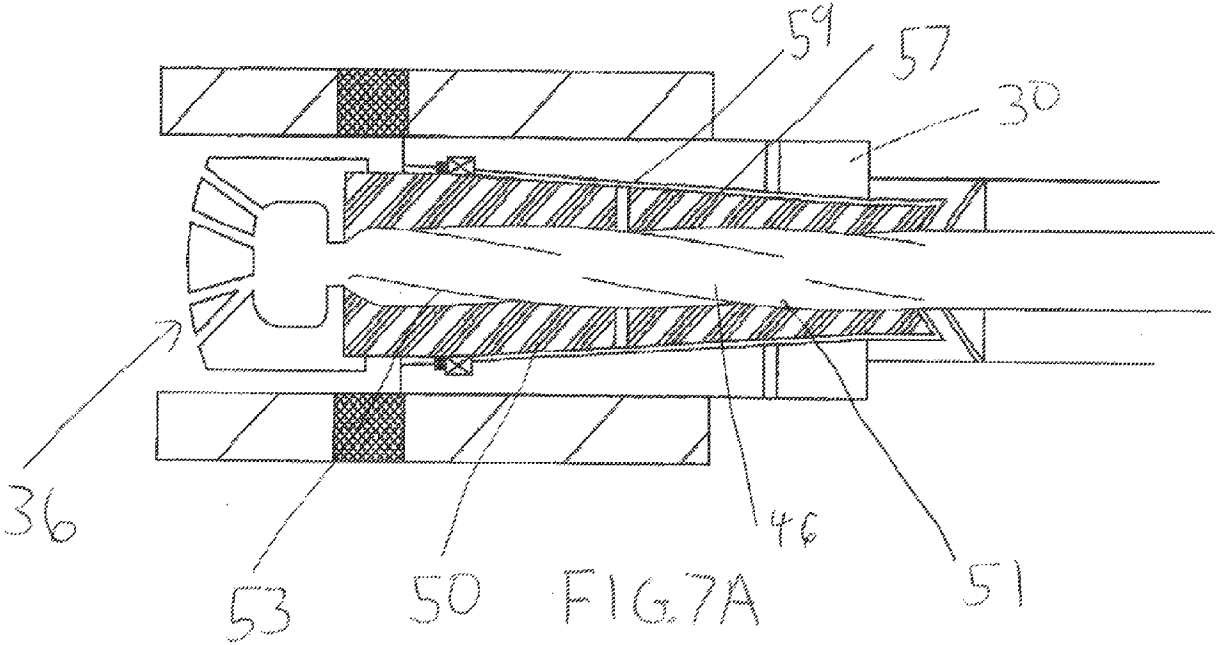
FIG. 7A is a longitudinal cross sectional view of an embodiment of a nozzle head assembly containing rifling on a surface of a rotatable shaft that can impart rotation.

FIG. 7A shows an embodiment and means of creating rotation of the nozzle head. In this embodiment, the rotatable shaft 50 is constructed such that fins, grooves, flutes or rifling 53 are positioned on the inside, or interior surface 51 of the shaft 50 and extend over some or all of the length of the shaft 50. As fluid, gases or a combination thereof flow through rotatable shaft 50 and impact the fins, grooves, flutes or rifling 53, an impeller is created whereby rotation is imparted to the shaft 50 and hence to rotatable nozzle head 36.

Figure 7B:
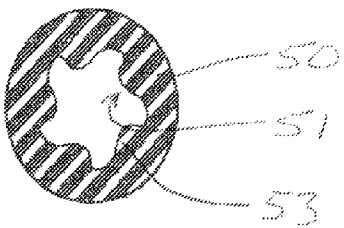
FIG. 7B is a radial cross sectional view of a rotatable shaft containing rifling on its inner surface.

FIG. 7B shows a radial cross section of the rotatable shaft 50 having an interior surface 51 having a rifling 53.

In an alternate embodiment, the rotatable shaft 50 is made such that fins, grooves, fluting or rifling are positioned on the outside, or exterior surface, 57 of the shaft 50 and extend some or all of the length of said shaft 50. As fluid, gases or a combination thereof flow around rotatable shaft 50 and impact the fins, grooves, flutes or rifling an impeller is created whereby rotation is imparted to the shaft 50 and hence to rotatable nozzle head 36.

In another alternative embodiment, the main body 30 is made such that fins, grooves, flutes or rifling are positioned on the inside, or interior surface, 59 of the main body 30 and extend some or all of the length of said body 30. As fluid, gases or a combination thereof flow across the inside of the main body 30 and impact the fins, grooves, flutes or rifling, a swirling pattern is created in the flow, imparting rotation to the shaft 50 and nozzle head 36.

As used herein, the term "earth's strata," also referred to as "earthen strata" or "strata," refers to the subterranean formation also referred to as earthen formation.

As used herein, the term "flexible tubing" refers to any hose, semi-rigid pipe, or hollow tubing that is able to flex or bend. The terms "flexible tubing," "hose," and "semi-rigid pipe" can be used interchangeably.

As used herein the term "whipstock" is used to include any downhole device which is able to position the rotating nozzle head assembly toward the earthen formation.

As used herein, the term "substantially horizontal direction" refers to a direction away from the vertical wall of the wellbore of from 1 degree to 179 degrees.

As used herein, the term "lateral" refers to a borehole that is drilled or cut from inside the wellbore and/or casing to a point away from the wellbore and/or casing in a substantially horizontal direction.

As used herein, the term "lateral jet drilling" refers to the drilling of a lateral borehole by means of pressurized gas or liquid or combinations thereof.

As used herein, the term "asymmetrically oriented" refers to the orientation, pitch, or angle of the centerline of an orifice which, when extended, does not intersect the axis of rotation of the nozzle head.

As used herein, the term "fluid bearing" refers to bearings which at least partially support the load of the bearing on a layer of liquid or gas.

Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Depending on the context, all references herein to the "invention" may in some cases refer to certain specific embodiments only. In other cases it may refer to subject matter recited in one or more, but not necessarily all, of the claims. While the foregoing is directed to embodiments, versions and examples of the present invention, which are included to enable a person of ordinary skill in the art to make and use the inventions when the information in this patent is combined with available information and technology, the inventions are not limited to only these particular embodiments, versions and examples. Other and further embodiments, versions and examples of the invention may be devised without departing from the basic scope thereof and the scope thereof is determined by the claims that follow.

What is claimed is:

1. An apparatus for cutting into an earthen formation, comprising:

a nozzle assembly having a nozzle head;

a flexible tubing connected to the nozzle assembly;

a means to position the nozzle assembly into earthen strata in a substantially horizontal direction;

wherein the nozzle assembly is connected to one end of the flexible tubing and the opposing end of the flexible tubing is coupled to a pumping unit capable of pumping gases, foams, fluids, or a combination thereof through the flexible tubing and nozzle assembly;

wherein the nozzle assembly comprises a nozzle body connected to the flexible tubing and the nozzle head is able to rotate and is connected to a rotatable shaft that is at least partially hollowed out so as to allow the flexible tubing to be in open fluid communication with the nozzle head;

wherein the nozzle body comprises a rotatable barrel body and the rotatable barrel body comprises the rotatable shaft such that the rotatable shaft is located inside the rotatable barrel body, wherein the rotatable shaft is adapted to receive a portion of the gases, foams, fluids, or a combination thereof from the flexible tubing and to deliver a portion of the gases, foams, fluids, or a combination thereof to the nozzle head.

2. The apparatus of claim 1, wherein the nozzle assembly comprises a fluid bearing between the nozzle body and rotatable shaft.

3. The apparatus of claim 2, wherein the fluid bearing is created in the presence of flow of the gas, fluid, or a combination thereof.

4. The apparatus of claim 1, wherein the nozzle head comprises at least one orifice.

5. The apparatus of claim 4, wherein the at least one orifice is asymmetrically oriented on the nozzle head.

6. The apparatus of claim 4, wherein the at least one orifice is skewed with respect to the axis of rotation of the nozzle head so as to provide a rotational impetus to the nozzle head in the presence of flow of the gas, fluid, or a combination thereof.

7. The apparatus of claim 4, wherein the nozzle head rotates under operating conditions due to an imbalanced thrust loading caused by at least one of the group consisting of the arrangement, the size, and the angle and combinations thereof of the at least one orifice when fluids, gases, or combinations thereof exit the at least one orifice.

8. The apparatus of claim 1, wherein the nozzle head comprises a hood that covers at least a portion of the circumference of the nozzle head.

9. The apparatus of claim 8, wherein at least a portion of the hood comprises perforations, grooves, or slots or combinations thereof 10. The apparatus of claim 8, wherein the hood has a larger diameter than the nozzle body and flexible tubing.

11. The apparatus of claim 1, further comprising a whipstock positioned in a wellbore providing a means to position the nozzle assembly into earthen strata in a substantially horizontal direction.

12. The apparatus of claim 11, wherein the whipstock contains a flow channel that allows for the removal of cuttings present in the wellbore.

13. The apparatus of claim 11, further comprising an external bypass to the whipstock.

14. The apparatus of claim 11, further comprising an internal bypass to the whipstock.

15. The apparatus of claim 11, further comprising tubing positioned atop the whipstock that is capable of receiving the flexible tubing wherein the inside diameter of the tubing ranges from 1.1 to 3.5 times the outside diameter of the flexible tubing.

16. The apparatus of claim 11, wherein the whipstock comprises a guide channel for directing the nozzle assembly to earthen strata adjacent to the whipstock.

17. The apparatus of claim 1, further comprising a flexible tubing containment apparatus capable of receiving the flexible tubing and restricting axial movement of at least a portion of the flexible tubing between the nozzle assembly and the pumping unit.

18. The apparatus of claim 17, wherein the flexible tubing containment apparatus comprises one or more of the group consisting of: collapsible sleeves; collapsible centralizers; stackable sleeves; tubing having an inside diameter that is greater than the outside diameter of the flexible tubing; or combinations thereof 19. The apparatus of claim 17, wherein the inside diameter of the containment apparatus ranges from 1.1 to 3.5 times the outside diameter of the flexible tubing.

20. The apparatus of claim 17, wherein the flexible tubing containment apparatus includes a lower section that forms a seal with the means to position the nozzle assembly into earthen strata in a substantially horizontal direction.

21. The apparatus of claim 1, wherein the rotatable barrel body contains at least one orifice at the rear of the barrel body and at least one orifice closer to the front of the barrel body such that a portion of the fluids, gases, or combinations thereof from the flexible tubing traverse an interior space of the barrel body creating a fluid bearing between the rotatable shaft and the barrel body and are delivered to the nozzle head.

22. The apparatus of claim 1, further comprising a second tubing string other than the flexible tubing, the second tubing capable of circulating gases, foams, fluids, or a combination thereof within a wellbore to remove cuttings and/or debris from the wellbore, wherein said circulation can be performed during one or more of: prior to creating the lateral borehole into the earth strata; periodically during creating the lateral borehole; continuously while creating the lateral borehole into the earth strata; or subsequent to creating the lateral borehole into the earth strata.

23. The apparatus of claim 1, wherein the rotatable shaft comprises fins, grooves, flutes, or rifling on its interior surface.

24. The apparatus of claim 1, wherein the rotatable shaft comprises fins, grooves, flutes, or rifling on its exterior surface.

25. The apparatus of claim 1, wherein the nozzle assembly or the flexible tubing contain one or more radially oriented centralizers on the outside surface of the nozzle assembly or the flexible tubing.

26. A method for penetrating earth strata surrounding a wellbore comprising:

inserting a downhole tool into a wellbore, the downhole tool comprising: a nozzle assembly having a rotatable nozzle head; a flexible tubing connected to the nozzle assembly; a means to position the nozzle assembly into earthen strata in a substantially horizontal direction; and wherein the nozzle assembly is connected to one end of the flexible tubing and the opposing end of the flexible tubing is coupled to a pumping unit capable of pumping gases, foams, fluids, or a combination thereof through the flexible tubing to rotate the nozzle head; wherein the nozzle assembly comprises a nozzle body connected to the flexible tubing and the nozzle head is connected to a rotatable shaft that is at least partially hollowed out allowing the flexible tubing to be in open fluid communication with the nozzle head; and wherein the nozzle body comprises a rotatable barrel body comprising the rotatable shaft such that the rotatable shaft is located inside the rotatable barrel body, wherein the rotatable shaft is adapted to receive a portion of the gases, foams, fluids, or a combination thereof from the flexible tubing and to deliver a portion of the gases, foams, fluids, or a combination thereof to the nozzle head;

guiding the downhole tool toward earthen strata in a substantially horizontal direction so that the nozzle head faces at least a portion of earth strata surrounding the wellbore;

ejecting gas, foam, fluid, or a combination thereof from the rotatable nozzle head into the earth strata; and creating a lateral borehole into the earth strata.

27. The method of claim 26, wherein the method further comprises removing cuttings from the wellbore via the circulation of gases, foams, fluids or combinations thereof 28. The method of claim 27, further comprising a second tubing string other than the flexible tubing, the second tubing capable of circulating gases, foams, fluids, or a combination thereof within a wellbore to remove cuttings and/or debris from the wellbore, wherein said circulation can be performed during one or more of: prior to creating the lateral borehole; periodically during creating the lateral borehole;

continuously while creating the lateral borehole; or subsequent to creating the lateral borehole into the earth strata.

29. The method of claim 26, wherein at least a portion of the fluids, gases or combinations thereof exit behind the rotating nozzle in order to create relatively higher pressures to force the fluids, gases or combinations thereof around the nozzle head, thereby removing debris.

30. The method of claim 26, wherein a fluid bearing is created within the nozzle assembly in the presence of flow of the gas, fluid, or a combination thereof 31. A method for penetrating earth strata surrounding a wellbore comprising:

inserting a downhole tool into a wellbore, the downhole tool comprising: a nozzle assembly having a nozzle head and a body, the nozzle assembly having either (a) a rotatable nozzle head or (b) a non-rotatable nozzle head having a device within the body for imparting a swirling or pulsing motion in the discharged fluid or for forming bubbles of cavitation; a flexible tubing connected to the nozzle assembly; a whipstock to position the nozzle assembly into earthen strata in a substantially horizontal direction; and wherein the nozzle assembly is connected to one end of the flexible tubing and the opposing end of the flexible tubing is coupled to a pumping unit capable of pumping gas, fluid, or a combination thereof through the flexible tubing to the nozzle head; wherein the nozzle assembly comprises a nozzle body connected to the flexible tubing and the nozzle head is connected to a rotatable shaft that is at least partially hollowed out allowing the flexible tubing to be in open fluid communication with the nozzle head; and wherein the nozzle body comprises a rotatable barrel body comprising the rotatable shaft such that the rotatable shaft is located inside the rotatable barrel body, wherein the rotatable shaft is adapted to receive a portion of the gases, foams, fluids, or a combination thereof from the flexible tubing and to deliver a portion of the gases, foams, fluids, or a combination thereof to the nozzle head;

guiding the downhole tool toward earthen strata in a substantially horizontal direction so that the nozzle head faces at least a portion of earth strata surrounding the wellbore;

ejecting gas, fluid, or a combination thereof into the earth strata from the nozzle head in a spiral or circular pattern or from a nozzle head designed to produce cavitation;

creating a lateral borehole into the earth strata; and circulating a portion of the gas, fluid, or a combination thereof through the whipstock to remove debris from the wellbore.

32. The method of claim 31, wherein the circulating of a portion of the gas, fluid, or a combination thereof can be performed during one or more of: prior to creating the lateral borehole into the earth strata; periodically during creating the lateral borehole; continuously while creating the lateral borehole into the earth strata; or subsequent to creating the lateral borehole into the earth strata.

33. The method of claim 31, wherein the circulating of a portion of the gas, fluid, or a combination thereof is performed while the nozzle assembly is located within the whipstock or when the nozzle assembly is not oriented in a substantially horizontal direction.

34. The method of claim 31, wherein the circulating of a portion of the gas, fluid, or a combination thereof is performed utilizing a second tubing string other than the flexible tubing.

35. The method of claim 31, further comprising a flexible tubing containment apparatus capable of restricting axial movement of at least a portion of the flexible tubing between the nozzle assembly and the pumping unit.

36. The method of claim 35, wherein the flexible tubing containment apparatus comprises one or more of the group consisting of: collapsible sleeves; collapsible centralizers; stackable sleeves; tubing having an inside diameter that is greater than the outside diameter of the flexible tubing; or combinations thereof 37. The method of claim 35, wherein the inside diameter of the containment apparatus ranges from 1.1 to 3.5 times the outside diameter of the flexible tubing.

38. The method of claim 35, wherein the flexible tubing containment apparatus includes a lower section that forms a seal with the means to position the nozzle assembly into earthen strata in a substantially horizontal direction.

39. The method of claim 31, wherein a fluid bearing is created within the nozzle assembly in the presence of flow of the gas, fluid, or a combination thereof.

* * * * *